United States Patent [19]

Stoody

[11] Patent Number: 5,012,956

[45] Date of Patent: May 7, 1991

[54] SQUEEZE BOTTLE WITH BAG, DISPENSING SYSTEM

[76] Inventor: William R. Stoody, 8659 Summerdale Rd., San Diego, Calif. 92126

[21] Appl. No.: 390,117

[22] Filed: Aug. 7, 1989

[51] Int. Cl.[5] ..... B65D 35/22

[52] U.S. Cl. ..... 222/94; 222/95; 222/206; 222/494

[58] Field of Search ..... 222/94, 95-96, 222/105, 206, 212-213, 386.5, 389, 131, 494

[56] References Cited

U.S. PATENT DOCUMENTS

| | | | |
|---|---|---|---|
| 3,486,661 | 12/1969 | Friedrich et al. | 222/95 |
| 4,147,278 | 4/1979 | Uhlig | 222/94 |
| 4,513,891 | 4/1985 | Hain et al. | 222/213 |
| 4,706,937 | 8/1988 | Evezich | 222/95 |
| 4,749,108 | 6/1988 | Dornsbusch et al. | 222/212 |
| 4,842,165 | 6/1989 | Van Coney | 222/95 |

*Primary Examiner*—Michael S. Huppert
*Assistant Examiner*—Gregory L. Huson

[57] ABSTRACT

A fluid dispenser system being a substantially conventional squeeze bottle within which a collapsible flaccid bag, containing dispensable fluid, is suspended. The bag is spaced from interior surfaces of the bottle and a pressure actuated valve, that facilitates fluid discharge and blocks against back flow entry of air into the bag, closes the bag. The bottle is vented, having a vent hole which is normally open, permitting air entry into the space between the interior surfaces of the bottle and the exterior surfaces of the bag. This vent hole requires obturation incidental with squeezing of the bottle, for fluid dispensing. In that situation air is trapped in the space and compressed, and indirectly exerts outwards pressure against the valve causing the valve to open, and promotes dispensing of the fluid whereby the bag progressively collapses as fluid is expelled.

9 Claims, 1 Drawing Sheet

SQUEEZE BOTTLE WITH BAG, DISPENSING SYSTEM

RELATED APPLICATION

Applicant's co-pending patent application, Ser. No. 337,151 filed Apr. 12, 1989 and still pending, is related to the present invention.

BACKGROUND OF THE INVENTION

The present invention relates to a novel self closing dispensing system, of the squeeze bottle class, within which fluid product to be dispensed is kept free from contaminating affects of air and in readiness for dispensing.

More specifically, this invention relates to an improved reusable squeeze bottle within which a collapsible flaccid bag, as disclosed in Applicant's co-pending application, containing dispensable fluid product is suspended in an air space and closed by a normally closed pressure actuated elastomeric valve that opens under outwards pressure indirectly applied thereon by a user's squeezing of said bottle for product dispensing. The valve, in its closed, state blocks back flow of air into the bag and thereby cooperates with the bag to keeps the product in dispensing readiness communication with the valve.

According to the invention, the bag progressively collapses as the product is dispensed and it remains in its collapsed state, keeping the product in dispensing readiness communication with the valve, between dispensing operations of the squeeze bottle. Dispensing can take place with the bottle in any attitude. This dispensing system is particularly useful for squirting fluids such as lubricating oils in an upwardly direction.

Heretofore squeeze bottle class dispensers have required the presence of air with the contained product and the product is allowed to settle at the bottom of the bottle between dispensing operations. And, for some viscous food products, such as mustard and honey, the bottle must be held in an upside down attitude and vigorously shook to gather product at the outlet, and be in an upside down attitude for dispensing. Even then dispensing is not entirely satisfactory because eructation of air with the product disrupts the product flow, and the bottle must be held in an upside down attitude during dispensing.

The present invention clearly advances the art of squeeze bottle dispensers and even more, it is a novel dispensing system that overcomes heretofore adversities of squeeze bottle dispensers. It enables dispensing in any direction, without regard to the attitude of the bottle, it provides undisrupted dispensing flow of fluid product, and it extends product freshness by keeping air away from product awaiting dispensation.

SUMMARY OF THE INVENTION

There is a need for a simple, squeeze bottle class, dispensing system that holds the product in a ready state for dispensing and facilitates dispensing of the product without regard to bottle attitude. The primary objective of the present invention is to satisfy that need by providing within said bottle a collapsible flaccid bag, for isolated containment of the fluid product, having a passive guide means that manages collapsing of the bag to insure that complete emptying of the bag will not be impeded.

Another objective is to provide a dispensing system, as stated in the foregoing objective, having a pressure actuated valve that facilitates product discharge and blocks entry of air into the bag.

Another objective is to provide a dispensing system, as stated in the foregoing objectives, having a vent hole that protects against inadvertent discharge of product.

Still another objective is to provide a dispensing system, as stated in the foregoing objectives, having a secondary cap that seals against the pressure actuated valve and insures against contamination and inadvertent discharge of said product during shipping and long term storage of said dispensing system.

An additional objective is to provide a dispensing system as stated in the foregoing objectives, having a reusable squeeze bottle that accommodates replaceable prefilled bags.

These and other objectives will be seen from the following specifications and claims in conjunction with the appended drawing.

THE DRAWING

DETAILED DESCRIPTION OF THE INVENTION

Specific terminology resorted to in describing the illustrated embodiments of the present invention is not intended to be limiting. It is understood that this is for clarity and includes all technical equivalents which function in a similar manner to accomplish a similar purpose or result. Well known variations of squeeze bottle dispensers are contemplated to be inclusive in the present invention.

Figure 1:
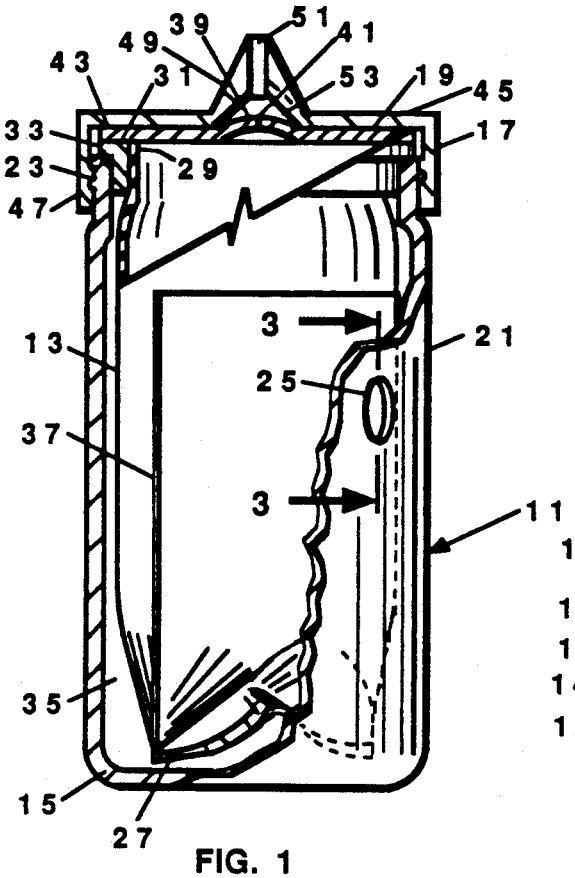
FIG. 1 is a longitudinal view of the dispensing system, of the present invention, having wall portions broken away for illustrative purposes.

Referring to the drawing, particularly FIG. 1, shown therein is a preferred embodiment of a fluid product dispenser system 11 of a class generally referred to as squeeze bottle. Said dispensing system includes; a collapsible flaccid bag 13 for containment of dispensable fluid product (not shown), an open mouth bottle 15, a conventional bottle closure 17, and a normally closed pressure actuated valve 19.

Bottle 15 is basically a common resilingly compliant plastic bottle having a cylindrical shape, resilingly deflectable side walls 21, and an externally threaded open end cylindrical neck 23 that constitutes the mouth of said bottle. Other resilingly compliant materials and configurations are equally suitable, however unlike common squeeze bottles, bottle 15 is provided with a side wall vent hole 25, also referred to as a vent means, that is located so as to be easily obstruated by finger coverage incidental with squeezing of said bottle for fluid product dispensing operation of said dispensing system.

The bag, which is shown in a filled (expanded) state, is preferably constructed from a length of cylindrical thin wall compliant plastic tubing that is heat sealed closed at its distal end, designated 27. The opposite end, open end 29 of said bag is provided with an annular fitment 31 having a circumferential flange 33 that is sealingly engaged with the open end of said bottle neck.

The bag is suspended loosely inside of said bottle, and spaced from the walls thereof, providing an air space 35 which is inside of said bottle and outside of said bag. Said air space communicates with atmosphere outside of said bottle via said vent means.

Disposed on said bag is a passive guide means 37 that influences the collapsing configuration of said bag. Guide means 37 is a thin rectangular sheet of resilingly compliant plastic that is laminated to a surface portion of said bag. The guide means manages collapsing of the bag by negating adverse resistances produced by bag wrinkles and enhancing propitious resistances, without compromising the attributes of the bag. And in so doing, the passive guide means prevents the proliferation and sustainment of fluid retention pockets that normally proliferate inside of flaccid bags, as the bags collapse, and block complete emptying of the bags. Said guide means and said fitment are integral members of the bag.

Valve 19 is a disc shape elastomeric component having a centrally located, upwardly projecting, concavo-convex bulge 39 having a transverse valvular slit 41. A planar flange 43, having a circumference that is approximately equal to circumference of said fitment flange, radially continues from said bulge. The valve is sealingly disposed on and closes the open end of said bag, and the bag and valve are retained in place relative to said bottle by bottle closure 17 which is secured to said bottle.

To produce the valvular slit, the bulge is held in a stretched state while a transverse cut through apex of the bulge is made. Thus, facing surfaces 41A and 41B, see FIG. 2, of the slit are normally biased together in a closed state, by elasticity of the valve.

Figure 2:
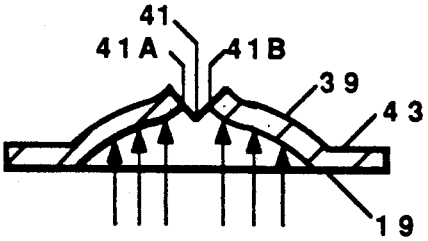
FIG. 2 is a cross sectional view illustrating the pressure actuated valve in an open state.

For dispensing, see FIG. 2, the bulge stretches outwardly and enlarges in response to outwards pressure (represented by arrows) exerted against the concave surface of the bulge. This stretching causes facing surfaces, 41A and 41B, of the slit to part whereby the valve is in an open state. When exertion of pressure is halted the valve resilingly returns to its normally closed state, whereby the opposing surfaces of the slit tend to tighten together. In said normally closed state, the bulge and valvular slit act together to resist against outward flow of fluid product from said bag, and to block inwards flow (back flow) of air into said bag.

Said bottle closure is essentially a bottle cap having a top circular closure wall 45 portion, which overlies the valve flange, having a depending circumferential wall 47 that is internally threaded and securingly engaged with the threaded neck of said bottle. The cap also includes an axial spout 49, which extends upwardly from said closure circular wall portion, having an outlet passageway 51 that is broadly flared at designation 53 wherein the valve bulge is nested.

It is to be understood that the bag may be either prefilled with dispensable fluid product or empty prior to placement into said bottle. For a prefilled bag a peel off closure foil (not shown) is provided over the open end of the bag, either beneath or covering the valve. The closure foil is removed, by the product user, after the bag is placed into the bottle. Vent hole 25 also facilitates placement the filled bag into the bottle by allowing escape of air, from the air space, to relieve back pressure produced by displacement of air inside of the bottle.

An empty bag merely requires filling with dispensable fluid product prior to installation of the valve and bottle closure. As the bag expands from an empty state to a filled state, air that is displaced in air space 35 is vented through vent hole 25. And, it has been found that filling is simplified when the empty bag is expanded by drawing air from the air space, through the vent hole, prior to filling.

Normally it is desirable for the vent hole to remain open, particularly with fluid product being contained in said bag, being open it protects against unintentional discharge of the bag's fluid content if the bottle is inadvertently squeezed. Squeezing of said bottle without incidental obturation said vent hole merely causes aspiration of air to and from said air space with no appreciable pressure being produced within said air space, therefore the valve remains in a closed state.

Dispensing operation of said dispensing system requires squeezing of said bottle incidental with obturation of the vent hole which is easily obturated by being covered with a thumb or finger tip as squeezing pressure is applied to the bottle. Squeezing of said bottle inwardly deflects the side walls thereof and, with said vent hole obturated, compresses air trapped in said air space and thereby creates pressure in said air space. This pressure uniformally acts against the bag causing the fluid product contained therein to be under pressure which consequently exerts outwards pressure against said valve causing the valve to open, and promotes dispensing of the fluid product regardless of the attitude of the bottle.

Thus squeezing of said bottle, incidental with obturation of said vent hole, indirectly exerts outwards pressure on said valve and thereby opens said valve and promotes dispensing of the fluid product. Fluid product, being under pressure exerted by squeezing of said bottle, discharges through the spout passageway and the bag correspondingly collapses occupying space vacated by the discharged fluid product.

Dispensing may be repeated so long as the bag contains fluid to be dispensed. And, since the valve blocks inwards flow of air into the bag, the bag remains collapsed between dispensing operations and thereby keeps the remaining fluid in dispensing readiness communication with the valve regardless of the attitude of said bottle.

Figure 4:
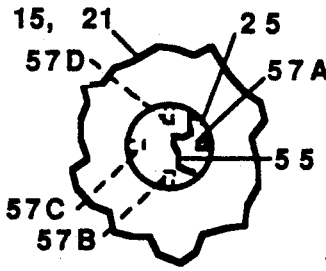
FIG. 4 is a frontal view, of the venting mean, taken in the direction of arrows 4—4 of FIG. 3.
Figure 3:
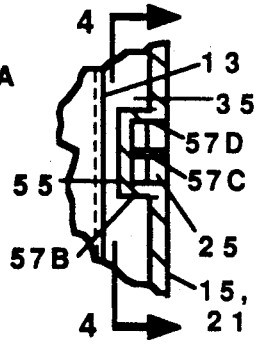
FIG. 3 is a cross sectional view, taken in the direction of arrows 3—3 of FIG. 1 illustrating a venting means for the dispensing system.

In FIGS. 3 and 4 vent hole 25 is shown having a baffle plate 55 that is joined to said vent hole by supports 57A, 57B, 57C and 57D, as best seen in FIG. 4, which hold said baffle plate inwardly from said vent hole to allow free flow of air into and out of space 35. Baffle plate 55 also serves to shield and protect the bag from being harmfully accessed through said vent hole A one-way vent valve that prevents effluence of air from said air space has been considered as an alternative vent means. However this alternative is not desirable because it would facilitate unintentional dispensing of fluid product and hinder the placement of a prefilled bag into said bottle.

MODIFICATION

In describing this modification, whenever practical, features and entities that are like or similar to those previously described are designated with numbers that respectively have the same last two digits as those numbers used in the foregoing described embodiment. Generally descriptions of features, functions and entities hereintofore described will not be repeated in any greater depth than necessary. Odd number designations, i.e., 11, 13, 15, etc., are used in describing the foregoing embodiment, so to denote therefrom even number designations are employed in the modification for describing supplemental features.

Figure 5:
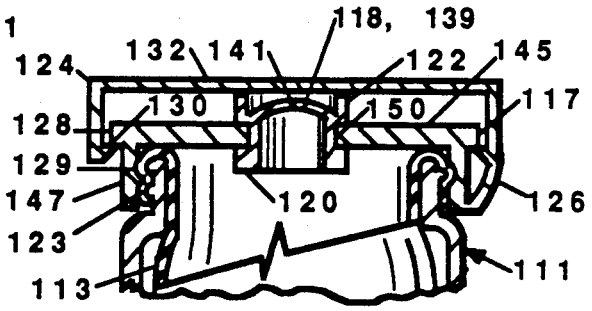
FIG. 5 is a longitudinal partial view, similar to FIG. 1, illustrating an alternative bottle closure for the dispensing system.
Figure 6:
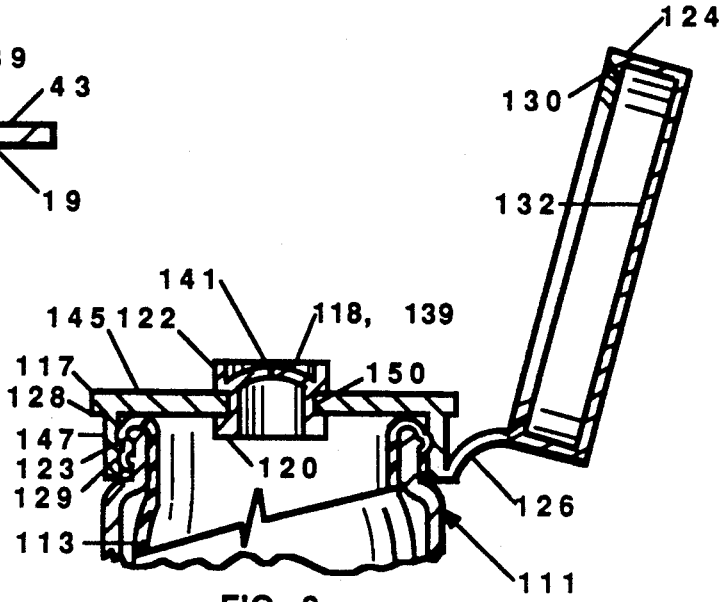
FIG. 6 is a longitudinal partial view, similar to FIG. 5, illustrating a the alternative bottle closure in an open position for dispensing.

A modified dispensing system 111 is shown in FIGS. 5 and 6. For this modification fitment 31, previously described, has been deleted and open end 129 of bag 113 is turned back and conformingly drawn down over externally threaded neck 123 of bottle 115 and sealingly secured in place between said neck and internally threaded wall 147 of bottle closure 117. The bag portion overlying the neck is in sealing compression between said neck and circular wall 145 of said bottle closure.

Also, in this modification spout 49 has been deleted and in its place circular wall 145 of said bottle closure is provided with a centrally located aperture 150 which accommodates a modified pressure actuated valve 118.

Valve 118, like valve 19, is an elastomeric component having a centrally located, upwardly projecting, concavo-convex bulge 139 having a transverse valvular slit 141. However unlike valve 19, valve 118 is in the form of a hollow plug having an annular distal end flange 120 and a raised annular rim 122, continuance of said bulge, which is spaced above said distal end flange.

Valve 118 is mounted in the aperture of said circular wall, such that the concavo-convex bulge protrudes above said circular wall. Rim 122 and flange 120 respectively extend radially beyond the periphery of aperture 150 and engage an opposite facing surface of said circular wall and thereby sealingly hold said valve in place.

Said bottle closure is provided an attached secondary cap 124 that is latched in place on said bottle closure, as seen in FIG. 5. Secondary cap 124 and said bottle closure are linked together by a flexible strap 126 so that unlatched, as seen in FIG. 6, the secondary cap remains conveniently attached to said bottle closure.

Preferably the secondary cap, bottle closure and strap are produced together as a single molded plastic part. It is to be understood that bottle closures having a secondary cap are well known and the configuration shown herein is merely a symbolic representation of the contemplated bottle closures.

To facilitate latching of secondary cap 124, the circular wall of said bottle closure is provided with a circumferential ledge 128, and said secondary cap is provided with a corresponding annular latching lip 130 that latchingly engages ledge 128 as seen in FIG. 5.

Said secondary cap is also provided with a top closure wall 132 which sealingly engages rim 122 portion of said valve when said latching lip is latchingly engaged with said ledge. Engagement of the secondary cap closure wall with said rim provides a positive sealing means which insures air tight closure of said valve during shipment and long term storage of dispensing system 111.

It is believed to be self evident that the valve may be molded in place (not shown) in said bottle closure, using liquid silicone or other resilient material, whereas said bottle closure is an integral part of said valve, and said distal end flange may alternatively extend over and engage the open end of said bag.

Having described my invention, reference should now be had to the following claims.

I claim:

1. A squeeze bottle class dispensing system for isolated containment and dispensing of fluid product therefrom, which comprises:

a bottle having resilingly deflectable side walls, and an easily obturated vent means which facilitate squeezing of said bottle for dispensation of said fluid product;

at least one collapsible bag, containing dispensable fluid product, being suspended within said bottle and spaced from said walls;

a normally closed valve, which facilitates containment and dispensation of said fluid product, being disposed on and closing said bag;

and a bottle closure being secured to said bottle and thereby retaining said valve and said bag in place relative to said bottle;

said bag having, integral therewith, a passive guide means that promotes collapsing of said bag and thereby ensures against proliferation and sustainment of fluid retention pockets in said bag;

said fluid product within said bag being in dispensing readiness communication with said valve regardless of attitude of said dispensing system.

2. A squeeze bottle class dispensing system for isolated containment and dispensing of fluid product therefrom, which comprises:

a bottle having resilingly deflectable side walls, and an easily obturated vent means which facilitate squeezing of said bottle for dispensation of said fluid product;

at least one collapsible bag, which is adapted for containment of dispensable fluid product, being suspended within said bottle and spaced from said walls;

a normally closed valve, which facilitates containment and dispensation of fluid product, being disposed on and closing said bag;

and a bottle closure being secured to said bottle and thereby retaining said valve and said bag in place relative to said bottle;

said bag having, integral therewith, a passive guide means that promotes collapsing of said bag and thereby ensures against proliferation and sustainment of fluid retention pockets in said bag;

said bag being adapted to keep fluid product in dispensing readiness communication with said valve regardless of attitude of said dispensing system.

3. A squeeze bottle class dispensing system for isolated containment and dispensing of fluid product therefrom, which comprises:

a bottle having resilingly deflectable side walls, and an easily obturated vent means which facilitate operation of said bottle for dispensation of said fluid product;

at least one collapsible flaccid bag, containing dispensable fluid product, being suspended within said bottle;

an air space being inside of said bottle and outside of said bag, and communicating with atmosphere outside of said bottle via said vent means;

a normally closed pressure actuated valve, which responsively opens under outwards exertion of fluid pressure thereon, being disposed on and closing said bag;

and a bottle closure being secured to said bottle and thereby retaining said valve and said bag in place relative to said bottle;

said bag having, integral therewith, a passive guide means that promotes collapsing of said bag and thereby ensures against proliferation and sustainment of fluid retention pockets in said bag;

said operation being squeezing of said bottle incidental with obturation of said vent means, whereas squeezing of said bottle incidental with obturation of said vent means deflects said walls inwardly and indirectly exerts outwards pressure on said valve and thereby opens said valve and promotes dispensing of said fluid product regardless of the attitude of said bottle.

4. In the invention of claim 3, said vent means having a baffle plate which protects said bag.

5. In the invention of claim 3, said valve being an elastomeric component having an upwardly projecting concavo-convex bulge having a transverse valvular slit.

6. In the invention of claim 3, said bottle closure being an integral part of said valve.

7. In the invention of claim 3, fluid product within said bag being in dispensing readiness communication with said valve regardless of attitude of said dispensing system.

8. In the invention of claim 3, said bottle closure having an attached secondary cap.

9. In the invention of claim 8, said cap being a positive closing means for said dispensing system.

* * * * *